United States Patent [19]

Weekly

[11] 4,114,967

[45] Sep. 19, 1978

[54] DRAWER

[76] Inventor: Jon L. Weekly, 2722 Rawhide La., Lawrence, Kans. 66044

[21] Appl. No.: 830,061

[22] Filed: Sep. 2, 1977

[51] Int. Cl.[2] ..... A47B 88/18

[52] U.S. Cl. ..... 312/328; 220/337

[58] Field of Search ..... 312/326, 327, 328, 329; 220/337, 338, 340; 16/171, 149, 179

[56] References Cited

U.S. PATENT DOCUMENTS

| | | | |
|---|---|---|---|
| 2,801,737 | 8/1957 | Derman | 312/328 |
| 2,977,175 | 3/1961 | Bonomo | 312/328 |
| 3,292,983 | 12/1966 | Service | 312/329 |

FOREIGN PATENT DOCUMENTS

| | | | |
|---|---|---|---|
| 1,032,836 | 7/1953 | France | 312/328 |
| 334,429 | 9/1930 | United Kingdom | 312/328 |

*Primary Examiner*—Kenneth J. Dorner

*Attorney, Agent, or Firm*—Schmidt, Johnson, Hovey & Williams

[57] ABSTRACT

A drawer providing structure having a tray-like article receiving area therein adapted to be attached to an existing panel member ordinarily used to decoratively cover an opening in a cabinet wherein an obstruction, such as a sink fixture, closely spaced behind the opening precludes the use of a conventional, elongate sliding type drawer therein. The drawer includes a hinge defining notch formed integral therewith for frictionally engaging an adaptable hinge plate which is stationarily mounted on the lower ledge of the cabinet opening to provide an especially simple but smoothly operable hinge combination for retaining and swingably supporting the drawer within the cabinet opening. The hinge plate is adapted for use with various types of panel members, and the drawer is provided with stop elements formed integral therewith for engaging the cabinet to limit the swinging travel of the drawer.

4 Claims, 6 Drawing Figures

DRAWER

BACKGROUND AND BRIEF DESCRIPTION OF THE INVENTION

This invention generally deals with a drawer apparatus and pertains more particularly to a novel drawer structure which includes a unique means for swingably mounting the same within an opening of a cabinet or the like.

Slidable drawers have long been provided in built-in type cabinetry which is now in widespread use, particularly in the kitchen and bathrooms of residences. This type of cabinetry typically includes a waist level countertop, immediately below which there is normally provided a vertical cabinet face having one or more drawer-receiving openings therein within which openings there is mounted one or more elongate, slidable drawers of the common type. Often, however, the countertop has appliances or service fixtures mounted through the work surface thereof, in which case the fixture often extends below the level of the countertop whereby to present an obstruction to the path of travel of a drawer of any usable length which would otherwise be installed beneath the countertop in general vertical alignment with the fixture. Thus, drawers of the known type, and particularly those of the slidable variety having guide support members which extend rearwardly into the interior of the cabinet a substantial distance, cannot be installed immediately in front of the mentioned fixtures. However, most service fixtures which are mounted through the countertop do not ordinarily extend the full depth of the countertop, so that there usually remains a usable space lying between the fixture and the cabinet face. The present invention is aimed at providing a unique drawer structure which effectively utilizes this ordinarily wasted space between the cabinet face and the service fixture.

According to the present invention, a novel drawer structure is provided which is adapted to be attached to the back of a panel member that ordinarily covers an opening in the face of a cabinet. The structure includes a back wall, a bottom wall, and side walls joined together to form, in combination with the panel, a tray-like, article receptacle area. The side walls extend below the receptacle area and include a notched portion therein, adapted to frictionally engage a hinge plate which is stationarily mounted on the cabinet face within the opening of the latter, whereby to provide an especially simple pivotal support for swingably mounting the drawer within the opening. The hinge plates are novelly adapted for use with various types of panel configurations. Portions of the side walls also extend above the receptacle area to provide stop elements which are adapted to engage the cabinet when the drawer is swung outwardly for access, in order to limit the outward travel of the drawer. After installation of the hinge plates on the cabinet, and attachment of the drawer structure to the panel, the drawer may be removably installed by simply inserting the same into the cabinet opening and lowering the notched portions of the drawer onto the hinge plates.

Accordingly, it is an important object of the invention to provide a drawer structure adapted to be attached to a panel covering an opening in a cabinet face, which requires a minimum mounting depth within the cabinet, but yet which effectively utilizes a marginal portion of space present between the front face of the cabinet and an obstruction spaced therebehind.

Another object of the invention is to provide a drawer structure of the mentioned type which is pivotally supported upon the cabinet, within an opening in the face of the latter, to swingably mount an article receptacle tray within the cabinet. As a corollary to the foregoing object, it is a further object to provide an especially simple means for hinging the drawer structure upon the cabinet, which facilitates simple and rapid installation of the drawer, as well as removal of the drawer from the cabinet.

A still further object of the invention is to provide a drawer structure having hinge means of the type described, which is readily adaptable for use with various types of panel configurations.

Another object of the invention is to provide a drawer structure having a stop element formed integral therewith which is adapted to engage the cabinet upon opening of the drawer for access thereto, to limit the travel of the latter and thereby retain the drawer structure within the cabinet.

Other and further objects of the invention will be made clear or become apparent in the course of the following description of a preferred and alternate embodiment of the invention.

DETAILED DESCRIPTION OF THE INVENTION

In the accompanying drawing

Figure 4:
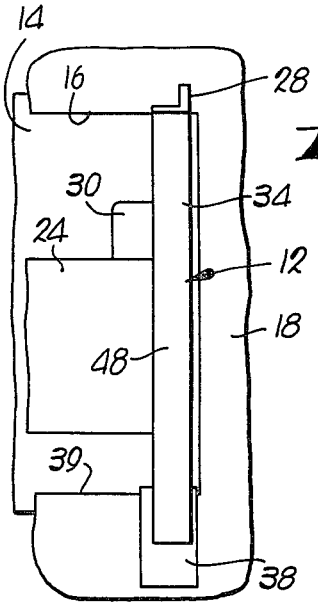
FIG. 4 is a fragmentary, rear elevational view of one end of the drawer, shown in the closed position within the cabinet.
Figure 5:
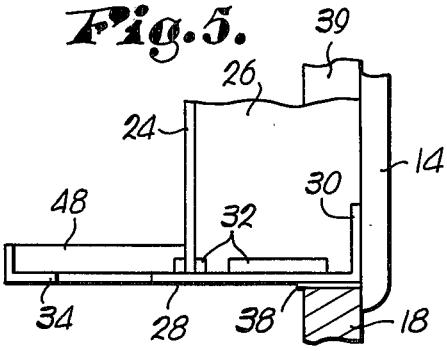
Figure 6:
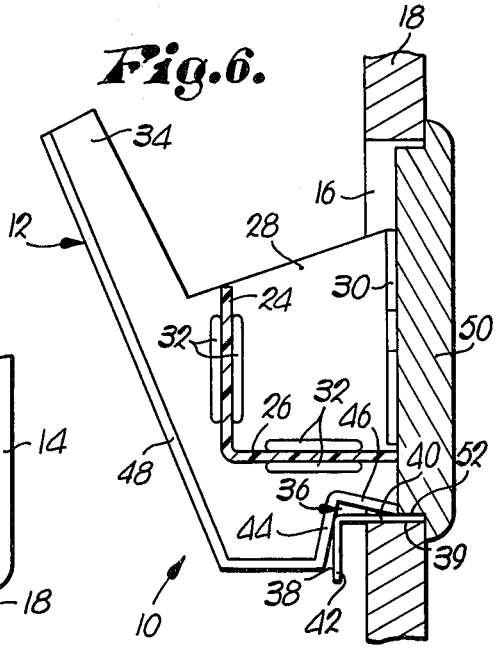

FIG. 5 is a fragmentary, top plan view of the end of the drawer shown in FIG. 4, depicted in the closed position, with parts of the front cabinet wall being shown in cross-section; and FIG. 6 is a fragmentary, cross-sectional end view of a drawer which comprises an alternate embodiment of the invention, shown in a closed position and depicting only a portion of the front cabinet wall and an opening therewithin.

Referring first to FIGS. 1–5, a drawer broadly designated by the numeral 10 comprises the combination of a drawer structure 12 and a panel 14, and is swingably mounted within an opening 16 in the front wall 18 of a cabinet structure which includes a countertop provided by an upper horizontal surface 20, through which countertop there is mounted a service fixture such as the sink fixture 22.

The drawer 10 extends longitudinally substantially parallel with the front cabinet wall 18. The forward wall (not shown) of the sink 22 extends below the level of the drawer 10 and is spaced from the front wall 18 a distance generally corresponding to the "depth" or front-to-back dimension of the drawer 10. The opening 16 is normally covered, for decorative purposes, by the panel 14 which is marginally larger than the opening 16, as best seen in FIG. 2, so that the outer, flat surface margins of panel 14 contact the periphery of the face of the wall 18 defining the opening 16 when the drawer 10 is in its closed position.

The drawer structure 12 may be manufactured from extruded plastic or the like and includes a back wall 24, bottom wall 26, and side walls 28, which are joined together to form, in combination with the interior side of the panel 14, an article receptacle area having an open top for user access thereto. Side walls 28 each include, at the forward extremities thereof, an inwardly depending mounting flange 30 which may be secured to the rear side of panel 14 by any suitable means in order to attach the drawer structure 12 to the panel 14. The longitudinal extremities of back wall 24 and bottom wall 26 are seated within the opposing pairs of support ribs 32 which are secured to, or formed integral with, the opposing faces of side walls 28. As best shown in FIGS. 2, 3, and 5, side walls 28 include upper surface portions which extend upwardly and somewhat rearwardly as viewed in FIG. 2, beyond the receptacle area and define stop ears 34. The bracket forming side walls 28 also each include lower surface portions which extend below the receptacle area, and which present a notched area 36 generally within the opening 16 to form, in combination with the hinge plate 38, a novel hinge means for swingably supporting the entire drawer 10 within the opening 16.

The generally L-shaped hinge plate 38 is stationarily mounted in vertical alignment with the notched area 36 on the ledge surface 39 provided by the lower edge of opening 16 and includes a major leg 40 extending downwardly, perpendicular to the minor leg 42, which latter leg is disposed horizontally within the opening 16. The notched area 36 in side walls 28 is partially defined by a rear surface portion 44 which extends diagonally forward with respect to front wall 18 and is adapted to frictionally engage the rear extremity of the minor leg 42, the notched area 36 being further defined by a forward surface portion 46 therein, which extends diagonally rearward with respect to the front wall 18 to form an essentially right angle with respect to the rear surface portion 44 and frictionally engages the forward extremity of minor leg 42. From the foregoing, it can be appreciated that the weight of the drawer 10 is supported by the ledge surface 39 through hinge plate 38, and is floatably hinged upon the latter in counterbalanced condition at a pair of sliding contact points with surface portions 44 and 46. A reinforcement lip 48 extending inwardly from rearward and lower margins of the side wall 28 (and including the notched area 36) is provided to insure smooth sliding contact with hinge plate 38.

Figure 1:
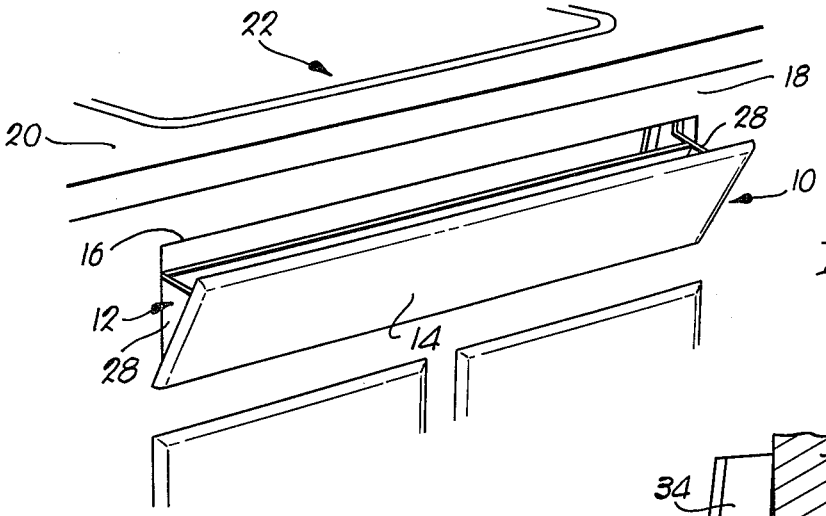
FIG. 1 is a fragmentary perspective view of a drawer which forms the present invention, shown in an open position and in operative relationship to a cabinet having a sink fixture mounted therewithin and in back of said drawer.
Figure 2:
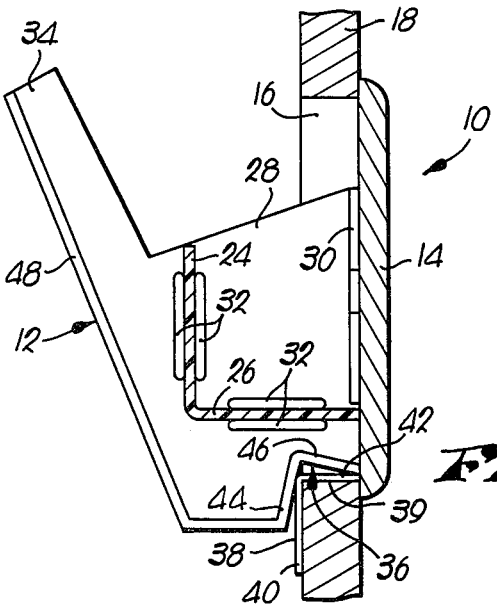
FIG. 2 is a fragmentary, cross-sectional end view of the drawer in a closed position within the cabinet, showing only a portion of the front cabinet wall and an opening therewithin.
Figure 3:
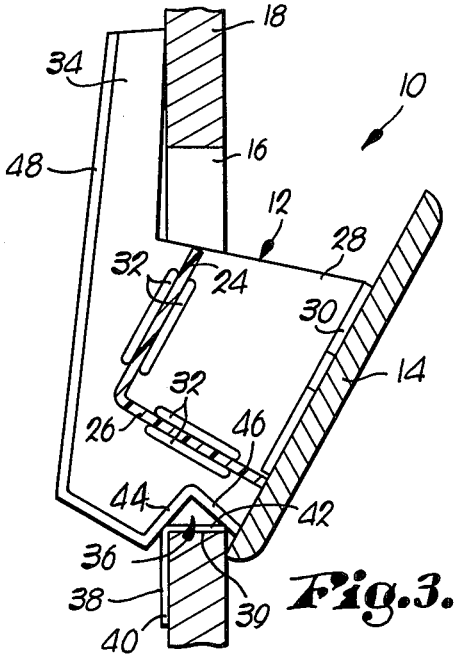
FIG. 3 is a view similar to FIG. 2, but showing the drawer in an open position to allow user access thereto.

Turning attention now to FIG. 6, it can be seen that the panel member 50 shown therein and representative of a second variety of commonly manufactured panels is somewhat thicker than the panel 14 shown in FIGS. 2, 3 and 5, and includes a rabbeted margin permitting a portion of the panel 50 to extend into the opening 16. The present invention is readily adapted for use with this second variety of panel by simply reversing the position of the hinge plate 38 whereby the major leg 40 thereof is secured in a horizontal position upon the ledge surface 39 in order that the hinge plate 38 spans the increased dimension formed between the contact points comprising the rear surface potion 44 and the rabbeted margin 52.

In use, the drawer structure 12 may be simply and rapidly installed to provide effective utilization of the space between the cabinet wall 18 and the sink 22. The user first removes the panel 14 (or 50) from the front of the wall 18 and secures the hinge plates 38 on the ledge surface 39 in the appropriate position on opposite ends of the latter. The drawer structure 12 may then be attached to the rear side of the panel 14 (or 50) and the resulting drawer 10 is then inserted into its operative position within the cabinet by first inserting the ears 34 through the opening 16, and then lifting and placing the notched area 36 of the drawer structure 12 onto the hinge plates 38. Thusly installed, the drawer 10 is held in its closed position by virtue of the fact that the center of gravity of the entire drawer 10 lies only slightly to the rear of a fulcrum point defined by the notched area 36, and also as a result of the frictional engagement between the notched area 36 and the hinge plate 38 which tends to releasably wedge the drawer 10 in its closed position. In order to open the drawer 10, a user swings the panel 14 (or 50) forwardly by means of a handle or the like (not shown) secured to the front of the panel 14 (or 50), whereupon the forward and rear surface portions 46 and 44 respectively, gently slide over the hinge plate 38 and permit the drawer 10 to smoothly pivot forwardly. As the drawer 10 pivots forwardly, the center of gravity of the latter quickly shifts to the opposite side of the mentioned fulcrum point, so that a coupling force produced by the weight of the drawer 10 causes the latter to continue its forward swinging movement without the aid of any further pulling force by the user. The forward travel of the drawer 10 is limited by virtue of the stop ears 34 contacting the front wall 18 of the cabinet, above the opening 16 therein, and the drawer 10 is held in its forwardmost, open position as a result of the upper areas of the same being prevented from moving forwardly due to stop ears 34, and as a result of the lower portions of the drawer 10 being constrained by the hinge plate 38.

The drawer structure 12 embodying the present invention may be constructed in essentially any desired length corresponding to the length of the panel member 14, while the maximum depth thereof (determined by the dimension between the front wall 18 and the stop ears 34) may be selected for accommodation by the space availability in a range of cabinet-fixture combinations. In some installations, it may be found that the spacing between the service fixture and the cabinet wall 18 is irregular such that adequate clearance is provided for the stop ear 34 of one end of the drawer structure 12 while the stop ear 34 of the opposite end thereof contacts the fixture to prevent the drawer 10 from completely closing; under these circumstances, the stop ear 34 contacting the fixture may simply be severed away from the drawer structure 12, and the remaining single stop ear 34 amply functions to limit the outward swinging movement of the drawer 10.

From the foregoing, it is clear that the invention provides especially simply means for swingably mounting a drawer structure between a cabinet wall and an obstruction spaced closely therebehind, but which is simply installed and may be readily adapted for use with cabinets having various types of panel members covering drawer openings therein. Thus, it will be observed that my drawer structure not only provides for the reliable accomplishment of the objects of the invention, but does so in a particularly simple and economical manner. It is recognized, of course, that those skilled in the art may make various modifications or additions to the embodiments chosen to illustrate the invention without departing from the gist and essence of my contribution to the art. Accordingly, it is to be understood that the protection sought and to be afforded hereby should be deemed to extend to the subject matter claimed and all equivalents thereof within the scope of the invention.

I claim:

1. For attachment to a cabinet and a panel member ordinarily covering an opening in the wall of said cabinet wherein one edge of said wall defining said opening presents a ledge for supporting a drawer thereon, said panel being of a type having a rabbeted margin overlying said wall portions and extending partially into said opening, a drawer assembly comprising:

structure adapted to be attached to one side of said panel member whereby the latter provides a front wall for said structure, said structure including a rear wall, sidewalls, and a bottom wall connected together and forming, in combination with said panel member, an article receptacle area normally disposed within said cabinet when said drawer is in a closed position, said structure further including surface portions adjacent said bottom wall, for frictionally engaging said cabinet ledge and cooperating with said panel member to provide a hinge means for retaining and pivotally supporting said drawer on said cabinet within said opening of the latter for swinging movement of said drawer between said closed position and an open position, said structure also being provided with a surface area adapted to engage said cabinet wall during swinging movement of said drawer, for limiting the travel of said structure away from said cabinet, said hinge means being generally disposed below said article receptacle area and said surface portions including a first straight stretch having the longitudinal axis thereof inclined with respect to the plane of said cabinet wall and frictionally engaging an inner edge of said ledge upon swinging movement of said drawer, a surface portion of said panel margin being disposed in spaced, opposed relationship to said first straight stretch and frictionally engaging an outer edge of said ledge upon swinging movement of said drawer; and a generally L-shaped hinge plate having a short leg and a long leg, for pivotally supporting said surface portions of said ledge, said plate being secured to said cabinet and extending essentially through said opening, at least one extremity of one of said legs being in slidable contact with said first straight stretch, said long leg of said hinge plate extending essentially through said opening, one extremity of said long leg being in slidable contact with said first straight stretch, the opposite extremity of said long leg being in slidable contact with said rabbeted margin of said panel member.

2. A drawer assembly adapted to be mounted on a panel member covering an opening in the wall of a cabinet wherein a portion of said wall defining said opening presents a ledge having a front, top, and rear face forming an essentially rectangular cross section for supporting a drawer thereon, including:

drawer structure including a front wall, a rear wall, a bottom wall, and sidewalls joined together to form an article receptacle area normally disposed within said cabinet when said structure is in a closed position, said drawer structure being provided with a hinge section therein adjacent said cabinet ledge, said hinge section including first and second adjacent, planar surface portions for supporting said drawer structure on said ledge, said first surface portion being inclined with respect to said top face of said ledge and overlying the latter whereby to form in combination with said second surface portion a clearance notch in said hinge section above said ledge for allowing pivotal shifting of said drawer structure and said panel member on said cabinet ledge, said second surface portion being inclined with respect to said rear face of said ledge, said first and second inclined surface portions slidably engaging the front and rear edges of said cabinet ledge and cooperating with the latter to pivotally mount said cabinet assembly in said opening.

3. The invention of claim 2, wherein:

said first surface portion is inclined upwardly in a direction from said front to said rear face of said ledge, and said second surface portion is inclined downwardly in said direction and has lower portions thereof spaced from said rear face of said ledge.

4. The invention of claim 3, further including:

an L-shaped hinge plate adapted for being secured on said cabinet ledge, said hinge plate having first and second legs respectively abuttingly contacting said top face and said rear face of said cabinet ledge, said first and second inclined surface portions slidably engaging only the opposite extremities of said first leg of said hinge plate when said assembly is pivoted between said closed position thereof and an open position.

* * * * *